US007710831B2

(12) United States Patent
Driska

(10) Patent No.: US 7,710,831 B2
(45) Date of Patent: May 4, 2010

(54) SINGLE DAY ALARM CLOCK

(75) Inventor: John J. Driska, Rahway, NJ (US)

(73) Assignee: SDI Technologies Inc., Rahway, NJ (US)

( * ) Notice: Subject to any disclaimer, the term of this patent is extended or adjusted under 35 U.S.C. 154(b) by 386 days.

(21) Appl. No.: 11/054,990

(22) Filed: Feb. 10, 2005

(65) Prior Publication Data

US 2006/0176779 A1 Aug. 10, 2006

(51) Int. Cl.
*G04B 47/00* (2006.01)
*G04C 21/00* (2006.01)

(52) U.S. Cl. ..... 368/10; 368/74

(58) Field of Classification Search ..... 368/10, 368/72–74, 250
See application file for complete search history.

(56) References Cited

U.S. PATENT DOCUMENTS 3,953,963 A * 5/1976 Nishimura et al. ..... 368/159
4,084,104 A 4/1978 Scherer
4,090,353 A * 5/1978 Maeda et al. ..... 368/188
4,095,410 A 6/1978 Kaneko
4,099,371 A * 7/1978 Mochizuki et al. ..... 368/249
4,107,916 A * 8/1978 Kondo ..... 368/251
4,187,468 A 2/1980 Kao
4,202,235 A * 5/1980 Namiki et al. ..... 84/649
4,421,418 A 12/1983 Morishima
4,487,512 A 12/1984 Price
4,731,765 A 3/1988 Cole et al.
5,089,998 A 2/1992 Rund
5,365,494 A 11/1994 Lynch
5,559,762 A 9/1996 Sakamoto
5,886,952 A * 3/1999 White ..... 368/10
6,678,215 B1 * 1/2004 Treyz et al. ..... 368/10
6,967,900 B2 * 11/2005 Chapman ..... 368/10
2004/0151076 A1 8/2004 Fidel
2005/0174889 A1 * 8/2005 Marcantonio et al. ..... 368/12
2005/0190654 A1 9/2005 Patel

* cited by examiner

*Primary Examiner*—Vit W Miska
(74) *Attorney, Agent, or Firm*—Arent Fox LLP

(57) ABSTRACT

A single day alarm clock radio includes a plurality of music setting buttons for setting different types of music; and having alarm buttons for setting an alarm for a radio mode, a buzzer mode, or an alarm off mode. A preset locking switch is provided for locking or unlocking the clock radio to allow the time to be preset, or the alarm time to be preset, or the radio station to be preset, or the type of music to be preset. Also provided is software for automatically cancelling a preset alarm time once it has sounded to change the alarm setting to the "off" mode so that a new hotel guest is not subject to the preset alarm time of the previous hotel guest.

19 Claims, 20 Drawing Sheets

*FIG. 7*

Stopping Alarm after alarm has gone off (in either radio or buzzer mode), pressing either of the following keys will deactivate the alarm.

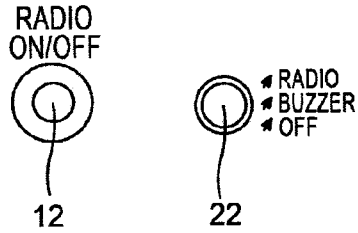

Snooze Bar

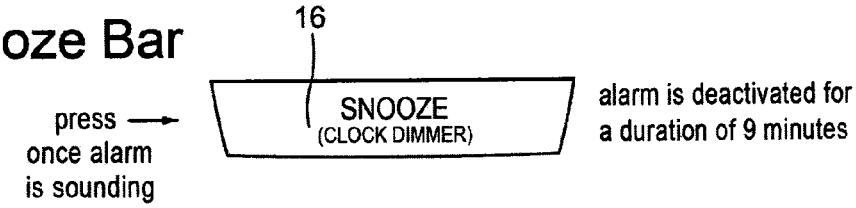

NOTE: After alarm has gone off, alarm mode defaults to "ALARM OFF"

Clock Dimmer

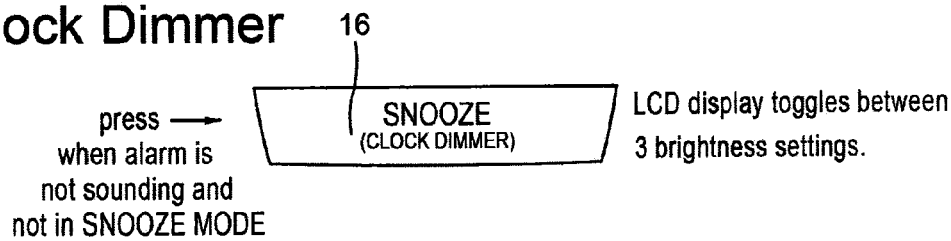

---

Night Light (optional provision)

Please make provision for nightlight option. Nightlight is always on and is controlled by changing CLOCK DIMMER as defined below:

Clock Dimmer (Brightest) = Nightlight (Brightest)
Clock Dimmer (Medium) = Nightlight (Medium)
Clock Dimmer (Lowest) = Nightlight (Lowest)

Selecting Alarm Mode:

(radio preset / buzzer / alarm off)

The alarm is on after completing steps on page 6

*FIG. 16*

Stopping Alarm after alarm has gone off (in either radio or buzzer mode), pressing either of the following keys will deactivate the alarm:

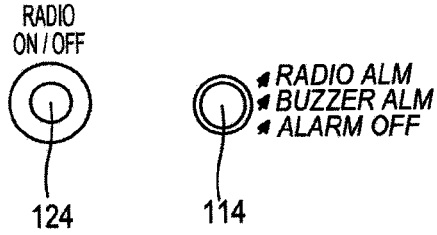

Snooze Bar

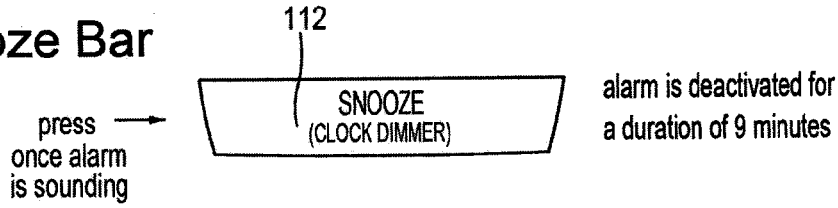

NOTE: After alarm has gone off, alarm mode defaults to "ALARM OFF"

Clock Dimmer

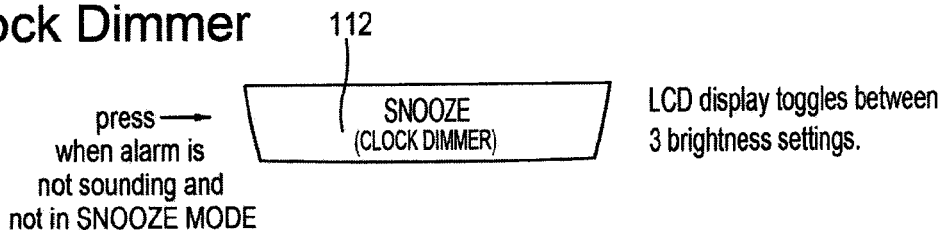

---

Night Light (optional provision)

Please make provision for nightlight option. Nightlight is always on and is controlled by changing CLOCK DIMMER as defined below:

Clock Dimmer (Brightest) = Nightlight (Brightest)
Clock Dimmer (Medium) = Nightlight (Medium)
Clock Dimmer (Lowest) = Nightlight (Lowest)

SINGLE DAY ALARM CLOCK

FIELD OF THE INVENTION

The present invention relates to a single day alarm clock where the alarm setting is automatically deactivated after the alarm sounds so that the new hotel guest is not subject to the preset alarm time of the previous hotel guest.

BACKGROUND OF THE INVENTION

Software operated alarm clock radios are well known in the art. Such alarm clock radios are programmable by the user to set an awake time convenient to the user within the parameters of the software for a particular alarm clock radio. The user directly controls the software circuit to let the alarm setting to be activated. However, there is a problem with hotel alarm clock radios not having the capability to automatically deactivate the alarm, once the alarm has sounded, such that the preset alarm time which was set by a previous hotel guest will be automatically deactivated.

There remains a need for a single day alarm feature for the alarm clock radio of the present invention where the alarm setting is automatically deactivated so that a new hotel/motel guest is not subject to the preset alarm time of the previous hotel guest.

DESCRIPTION OF THE PRIOR ART

Alarm clock radios and the like having various designs, structures and configurations have been disclosed in the prior art. For example, U.S. Pat. No. 4,016,562 discloses a switch-off device for an electrically operated clock alarm and control thereof. An electrically operable alarm is provided for a clock and includes a clock operated switch for turning the alarm on at a selected time. A manual switch is provided which, when opened momentarily, will cause a bistable switching circuit to go to a second condition in which the alarm remains silent until the clock operated switch again closes the next day. The manual switch is adjustable for preventing the alarm from sounding when the clock operated switch closes. This prior art patent does not disclose or teach the design and configuration of a single day alarm clock of the present invention.

The aforementioned prior art patent does not teach or disclose the programmable circuitry of a single day alarm clock for allowing the automatic deactivation of a preset alarm time set by a previous hotel guest in order for a new hotel guest to set a new alarm wake-up time for the guest's convenience.

Accordingly, it is an object of the present invention to provide a single day alarm clock that automatically deactivates a preset alarm setting after the alarm sounds such that a hotel guest is not subject to a previous alarm wake-up time.

Another object of the present invention is to provide a single day alarm clock that is easy to program and easy to use by a hotel guest.

Another object of the present invention is to provide a single day alarm clock that can be mass produced in an automated and economical manner and is readily affordable by a user.

SUMMARY OF THE INVENTION

A single day alarm clock radio is provided having a plurality of music setting buttons for setting different types of music; and having alarm buttons for setting an alarm for a radio mode, a buzzer mode, or an alarm off mode. A preset locking switch is provided for locking or unlocking the clock radio to allow the time to be preset, or the alarm time to be preset, or the radio station to be preset, or the type of music to be preset. Also provided is software for automatically cancelling a preset alarm time once it has sounded to change the alarm setting to the "off" mode so that a new hotel guest is not subject to the preset alarm time of the previous hotel guest.

BRIEF DESCRIPTION OF DRAWINGS

Further objects, features and advantages of the present invention will become apparent upon the consideration of the following detailed description of the presently preferred embodiment when taken in conjunction with the accompanying drawings, wherein:

FIG. 7 is a schematic representation of the single day alarm clock of the present invention showing the sequence of how to stop the alarm, how to operate a snooze bar and how to operate the clock dimmer on the controls of the single day alarm clock;

FIG. 16 is a schematic representation of the single day alarm clock of the present invention showing the sequence of how to stop the alarm, how to operate a snooze bar and how to operate the clock dimmer on the controls of the single day alarm clock;

DETAILED DESCRIPTION OF THE EMBODIMENTS

Preferred Embodiment 10

Figure 1:
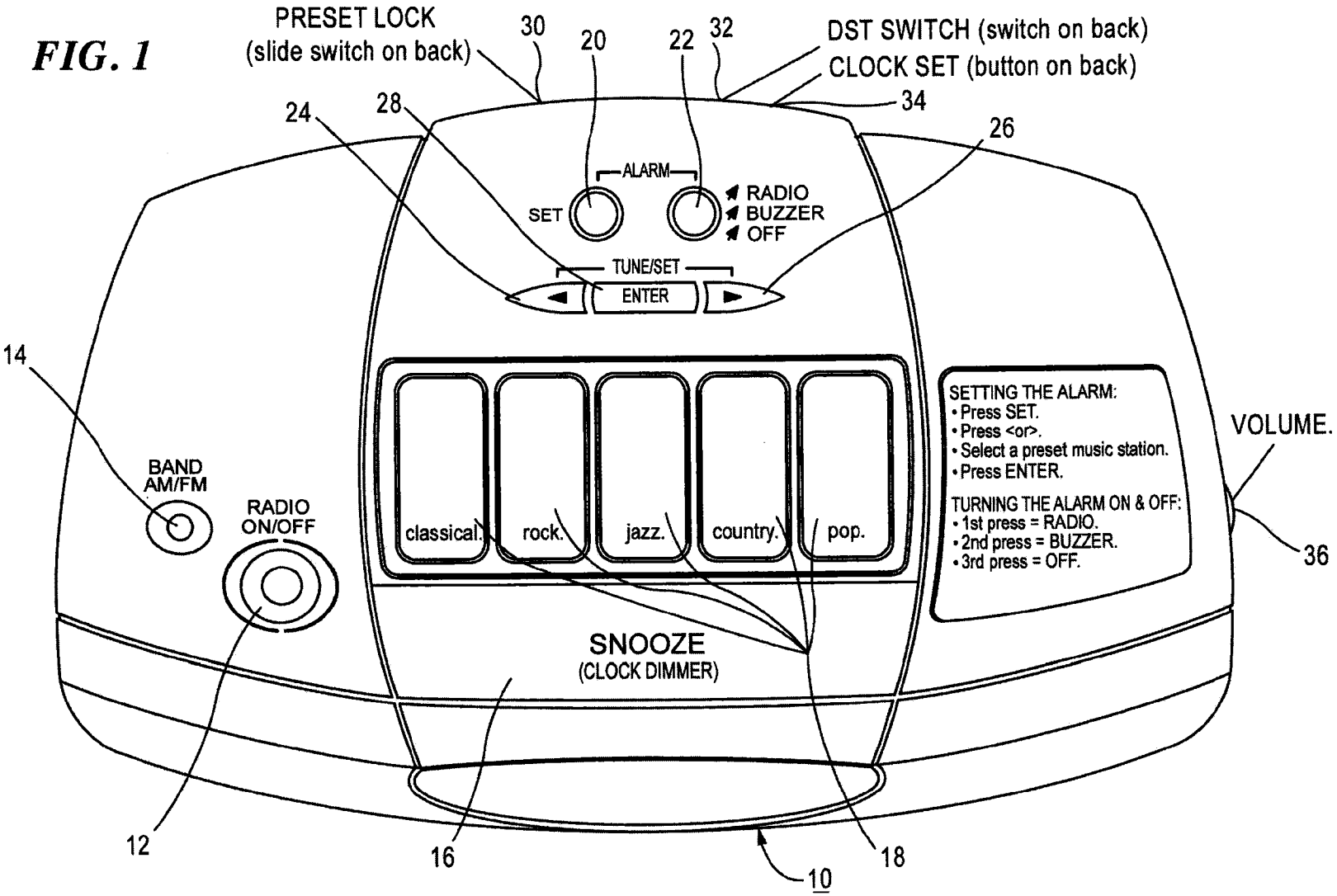
FIG. 1 is a top perspective view of the single day alarm clock of the preferred embodiment of the present invention showing the major component parts contained thereto and in an assembled state being readied for operational use thereof.

FIG. 1 shows clock radio 10 of the preferred embodiment of the present invention having an on/off button 12, an AM/FM button 14, a snooze bar 16, music setting buttons 18 for setting different types of music (classical, rock, etc.), alarm buttons 20 and 22, "tune/set" buttons 24 and 26, an "enter" button 28, a preset lock 30 in the form of a slide switch on the back, a DST (Daylight Savings Time) switch 32 on the back, a clock set switch 34 on the back, and a volume button 36.

When this clock radio is used in a hotel, for example, a maintenance person (of the hotel) presets in advance all the settings for the hotel guest and locks these settings, in the following manner.

Figure 2:
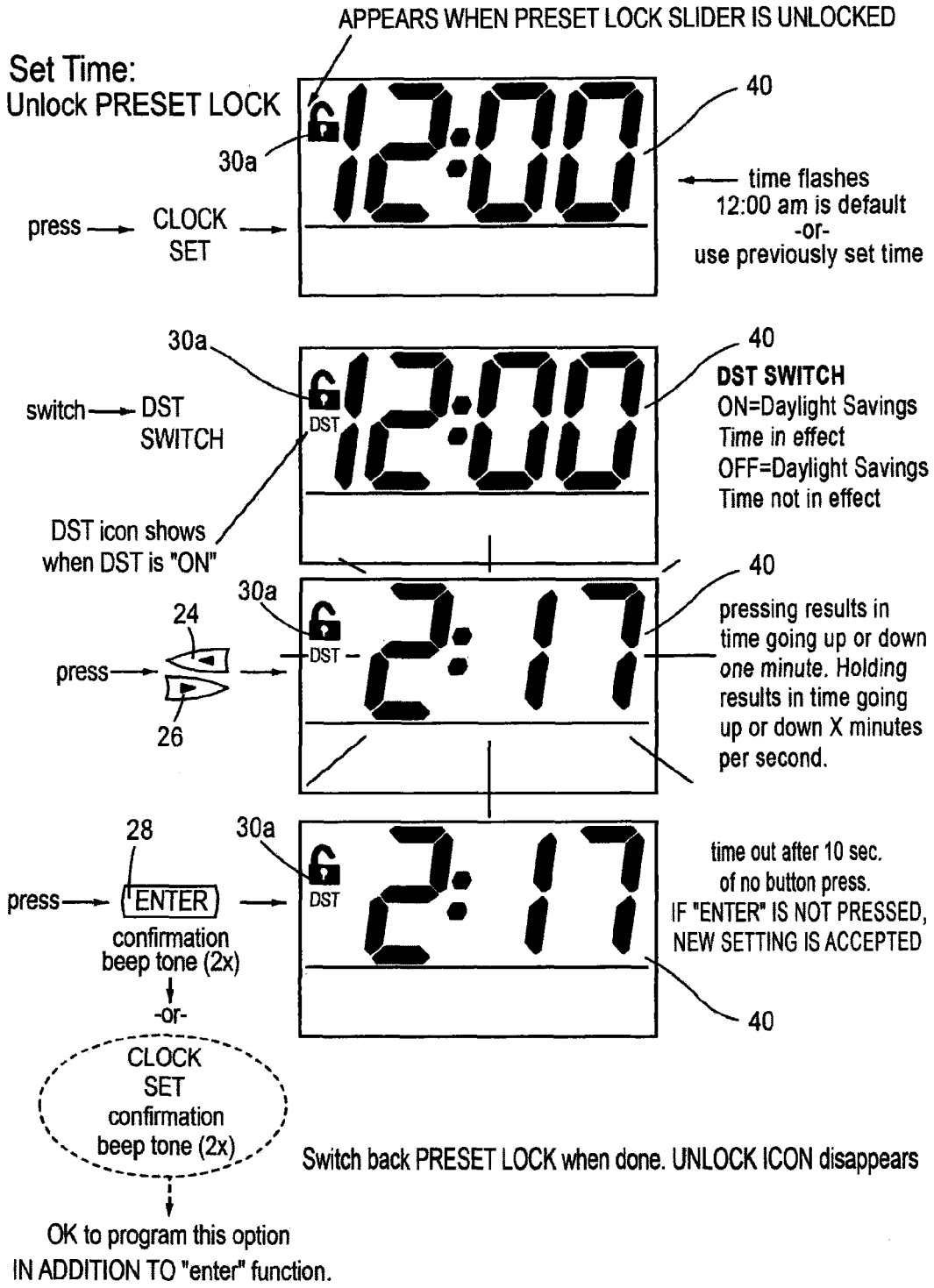
FIG. 2 is a schematic representation of the single day alarm clock of the present invention showing the sequence of how to preset time on a display window for displaying digital time.
Figure 3:
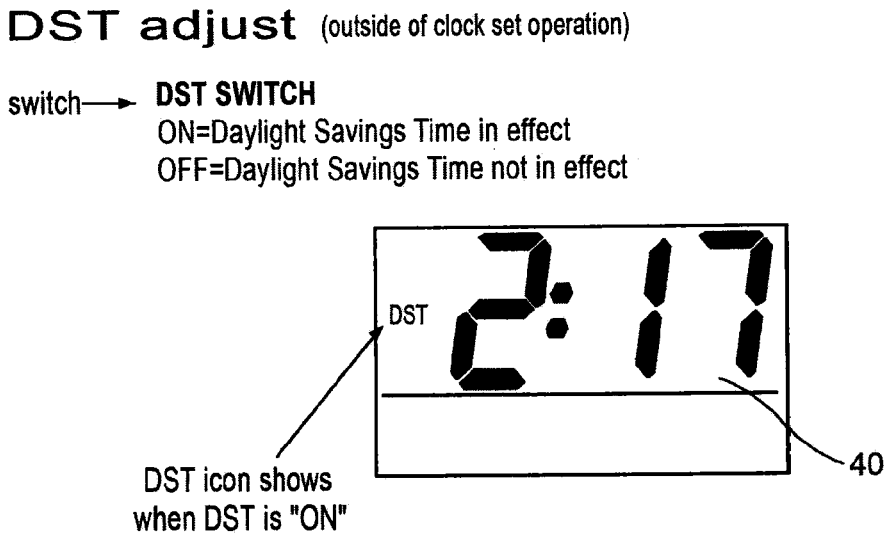
FIG. 3 is a schematic representation of the single day alarm clock of the present invention showing how to set "Daylight Savings Time" on the display window for displaying that the DST is "ON"

FIG. 2 illustrates how the time is preset by the hotel's maintenance person. The front of the clock 10 has a window 40 for displaying the digital time. Preset lock slide switch 30 is unlocked which is shown by the "unlock" icon 30*a* next to the digital readout of the time. The maintenance person then sets the time and presses the "clock set" button 34. If Daylight Savings Time is in effect, he also presses the DST button 32 to set it. To change the time up or down, the maintenance person presses "set" buttons 24 or 26 up or down until the correct time is reached. At that point, the "enter" button 28 is pressed to preset the time. To complete this step of the presetting, the maintenance person moves "lock" switch 30 back to its preset lock position, and the "unlock" icon 30*a* in the window 40 is no longer displayed.

Figure 4:
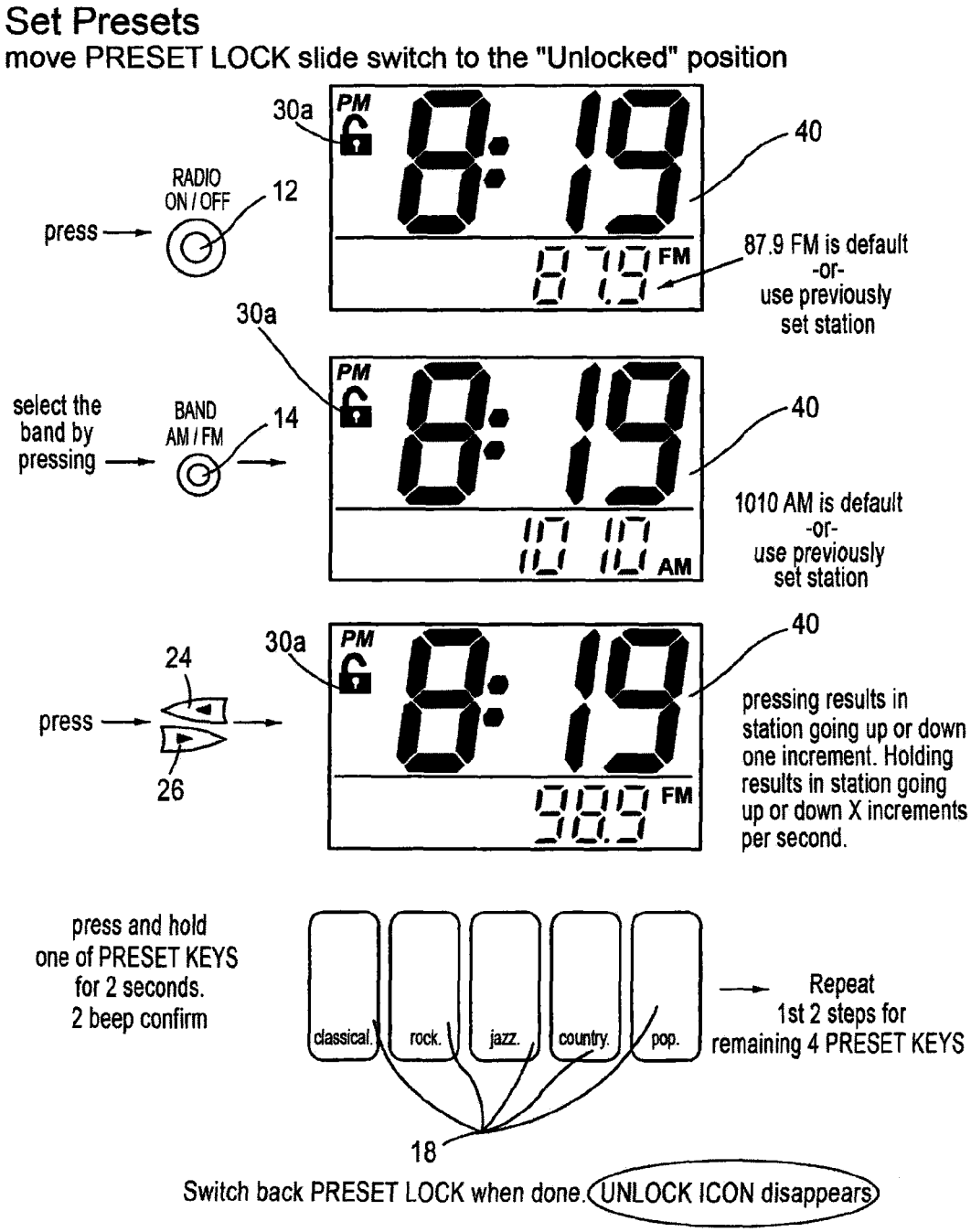
FIG. 4 is a schematic representation of the single day alarm clock of the present invention showing the sequence of how to preset a particular type of radio station on the display window for displaying a given radio station.

FIG. 4 illustrates how the radio station is preset by the hotel's maintenance person. Preset lock slide switch 30 is unlocked which is shown by the "unlock" icon 30*a* in window 40. The maintenance person then presses the "on" button 12 and then presses the "band" button 14 to select AM or FM. For example, as shown, 87.9 FM or 1010 AM may be preset. To change the station setting, the maintenance person presses set buttons 24 or 26 to go up or down the band to preset a station.

As part of this preset operation, the hotel staff selects one of the music setting buttons 18, to select and preset the type of music (classical, rock, jazz, country or pop), and does this by simply pressing and holding the selected music button 18 for 2 seconds, and wait for a 2 beep confirmation. To complete this step of the presetting operation, the maintenance person moves "lock" switch 30 back to its preset lock position, and the "unlock" icon 30*a* in the window 40 is no longer displayed.

Figure 5:
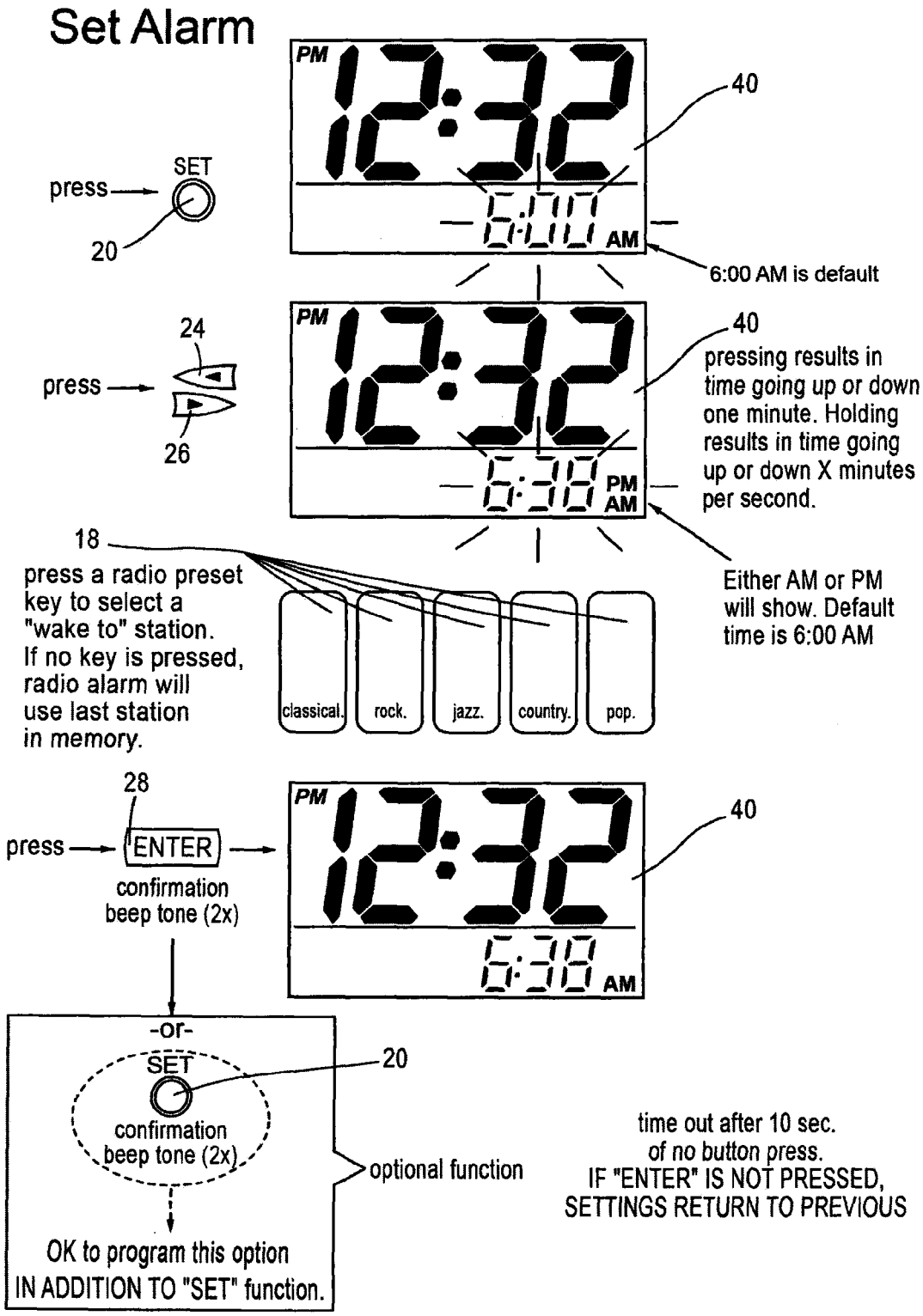
FIG. 5 is a schematic representation of the single day alarm clock of the present invention showing the sequence of how to preset a wake-up time for the alarm on the display window for displaying a selected wake-up time.

FIG. 5 illustrates how the alarm is set by the guest. The guest presses the "alarm set" button 20 and then presses set buttons 24 or 26 to change the alarm time up or down to, for example, 6:38 AM as illustrated in FIG. 5. Next, the person selects and presses one of the music setting buttons 18 to select and preset a particular type of music and station to wake to when the alarm goes off. This is followed by pressing "enter" button 28.

Figure 6:
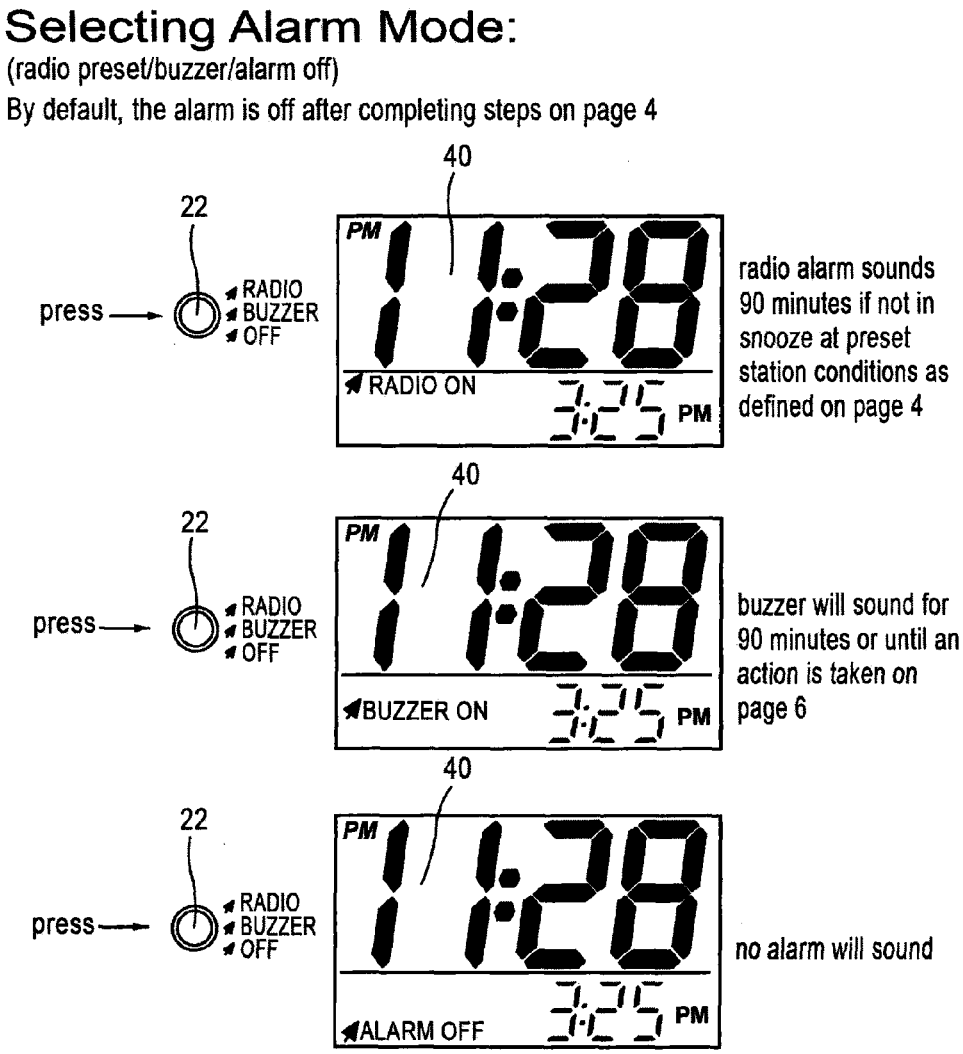
FIG. 6 is a schematic representation of the single day alarm clock of the present invention showing the sequence of how to set an alarm mode for the selected wake-up time on the display window for displaying a "Radio ON" mode or a "Buzzer ON" mode or an "Alarm OFF" mode.

FIG. 6 illustrates how the alarm mode is preset by the guest. If alarm button 22 is pressed once, the radio alarm mode is selected, which means the selected radio station will turn on when the preset alarm time is reached. Also, a display appears in window 40 that the "Radio Alarm" mode has been preset. If alarm button 22 is pressed twice, the buzzer mode of the alarm is selected, which means the alarm buzzer will sound when the preset alarm time is reached. Also, a display appears in window 40 that the "Buzzer" mode has been preset. If alarm button 22 is pressed three times, the alarm is off and it will not turn on the radio or buzzer. Also, a display appears in window 40 that the alarm is off.

Figure 8:
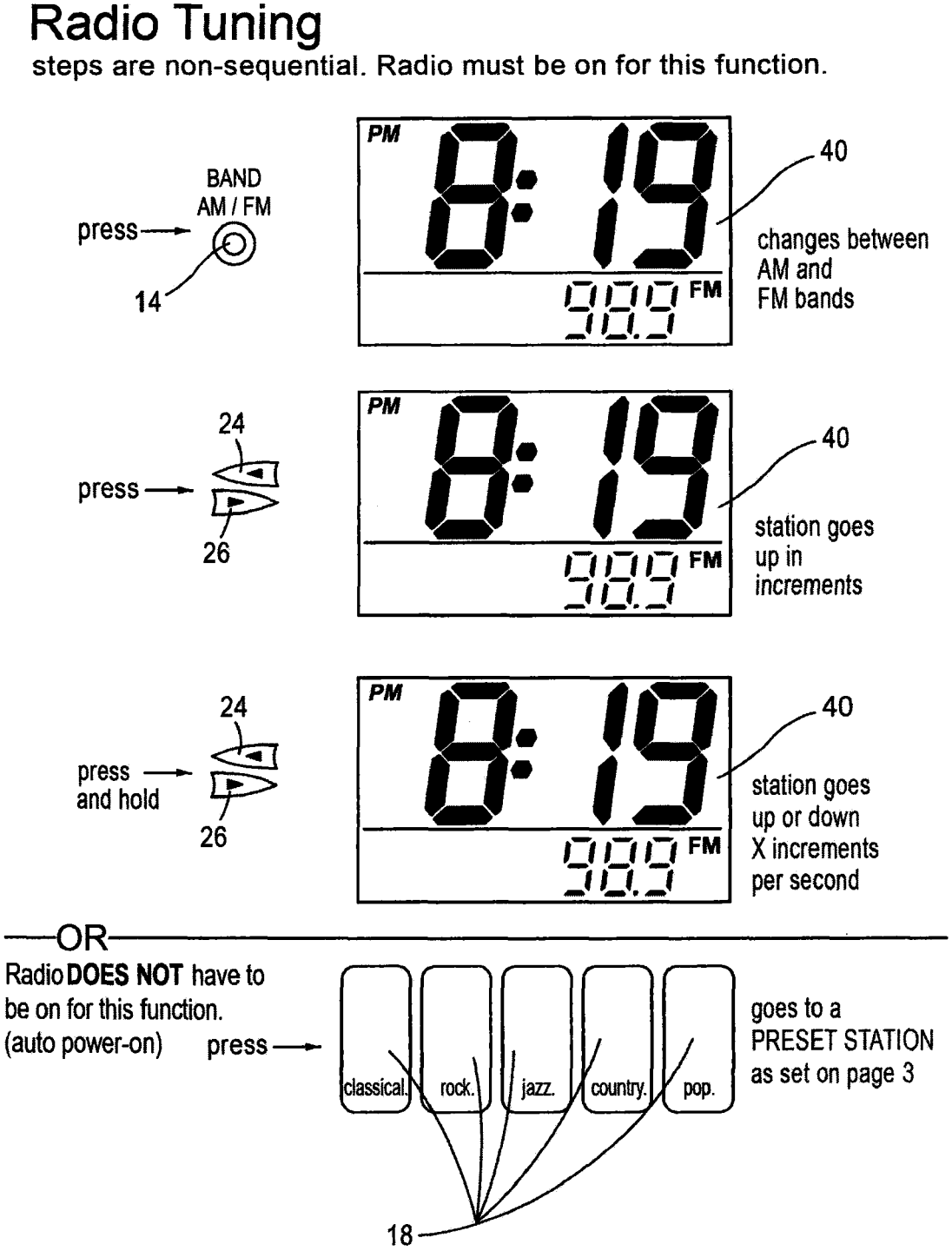
FIG. 8 is a schematic representation of the single day alarm clock of the present invention showing the sequence of how to tune-in a particular radio station on the display window.

FIG. 7 illustrates how to operate the snooze bar 16, and how to operate the clock dimmer. FIG. 8 illustrates how to tune the radio. These are conventional and known operations.

As a result of the present invention, a hotel guest arrives in the room, and the clock radio 10 has been preset in the manner described above. The advantage is that whatever time has been preset for the alarm to go off the previous night, by a prior guest, it will not stay preset for the new guest. The preset alarm time will automatically be deactivated and will change the alarm to the "off" mode, and automatically cancels whatever alarm time has been preset by the prior hotel guest. The new hotel guest is then free to set the alarm in the manner described above.

Alternate Embodiment 100

In this embodiment, the factory presets the time, the hotel presets the radio station, and the hotel guest presets the alarm.

Figure 9:
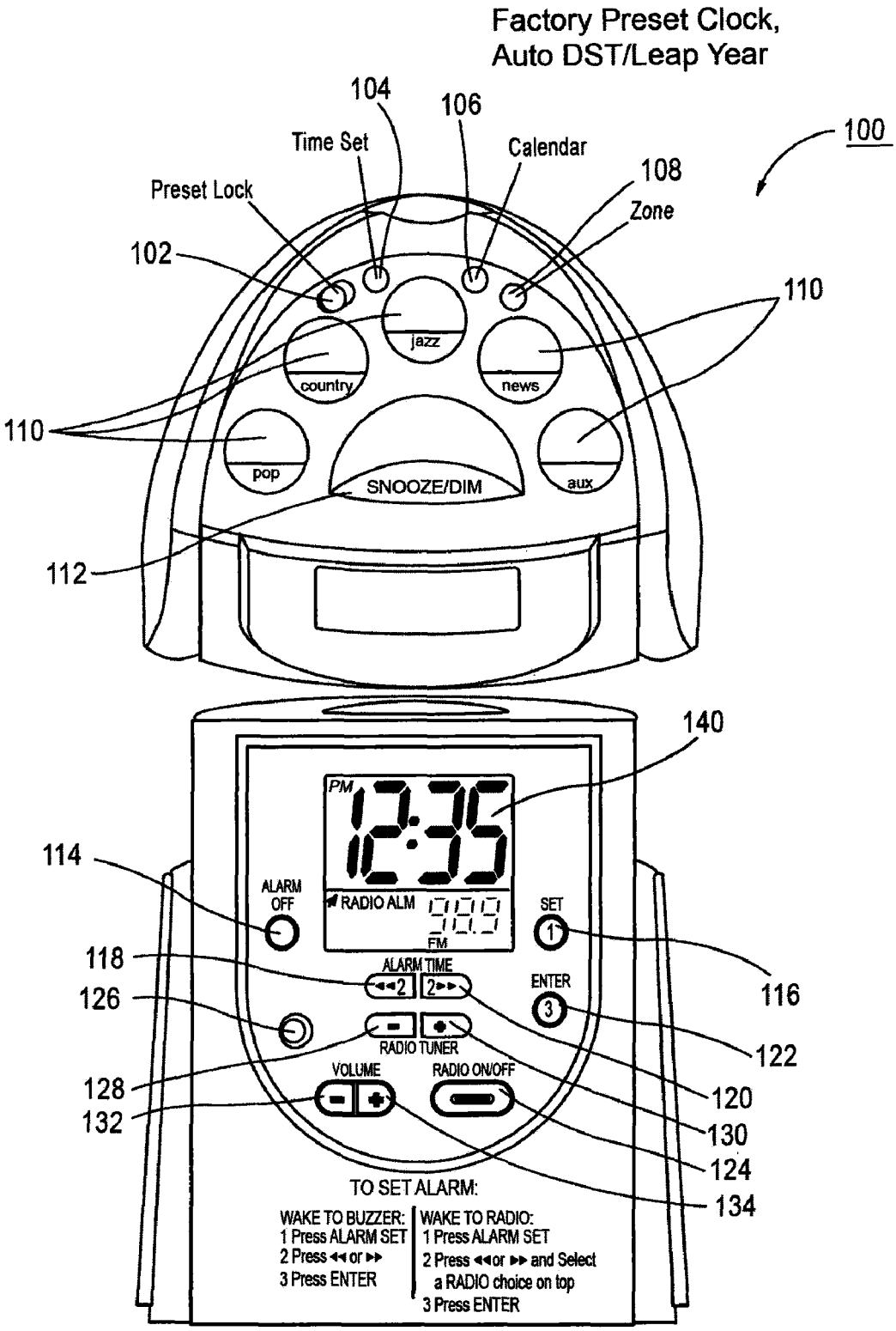
FIG. 9 is a top perspective view of the single day alarm clock of an alternate embodiment of the present invention showing the major component parts contained therein and in an assembled state being readied for operational use thereof.

FIG. 9 shows clock radio 100 of the alternate embodiment of the present invention having a preset lock slide switch 102, a time set button 104, a calendar button 106, a time zone button 108, music and news setting buttons 110 for setting different types of music or news (pop, country, jazz, etc.), a snooze and dimmer bar 112, an alarm off button 114, an alarm set button 116, alarm time buttons 118 and 120, an enter button 122, a radio ON/OFF button 124, a band AM/FM button 126, radio tuner buttons 128 and 130, volume control buttons 132 and 134 and a digital window display screen 140. When the preset lock slide switch 102 is in the unlocked position, an "unlock" icon 103 appears in the digital window of display screen 140.

When this clock radio 100 is used in a hotel, for example, the radio 100 is shipped from the factory with the time preset. Then the hotel and the hotel guest set the remaining settings, in the following manner.

Figure 10:
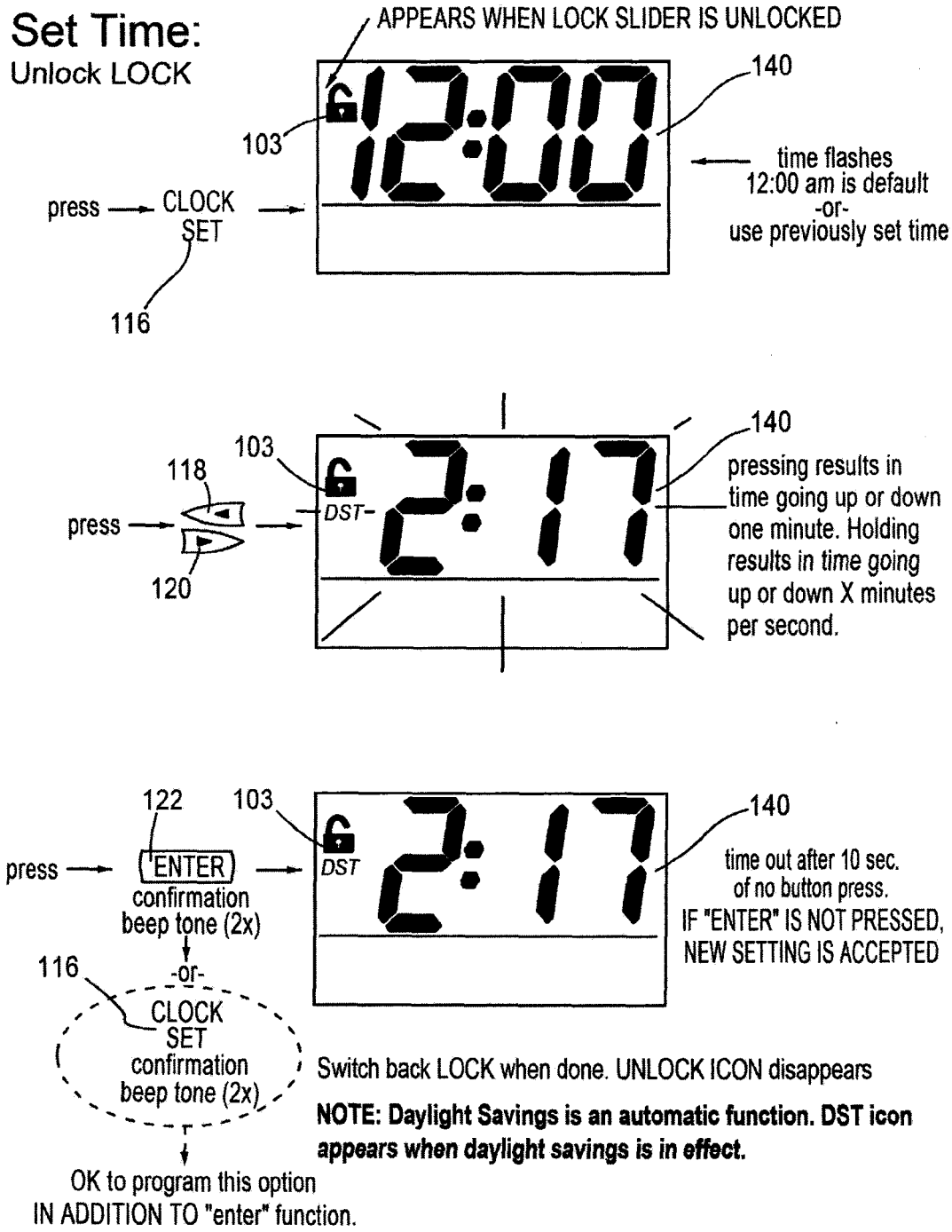
FIG. 10 is a schematic representation of the single day alarm clock of the present invention showing the sequence of how to preset time on a display window for displaying digital time.

FIG. 10 illustrates how the time is preset by the factory's programmer representative, or by the hotel, and follows the same programming steps as shown in FIG. 2 of the preferred embodiment.

Figure 11:
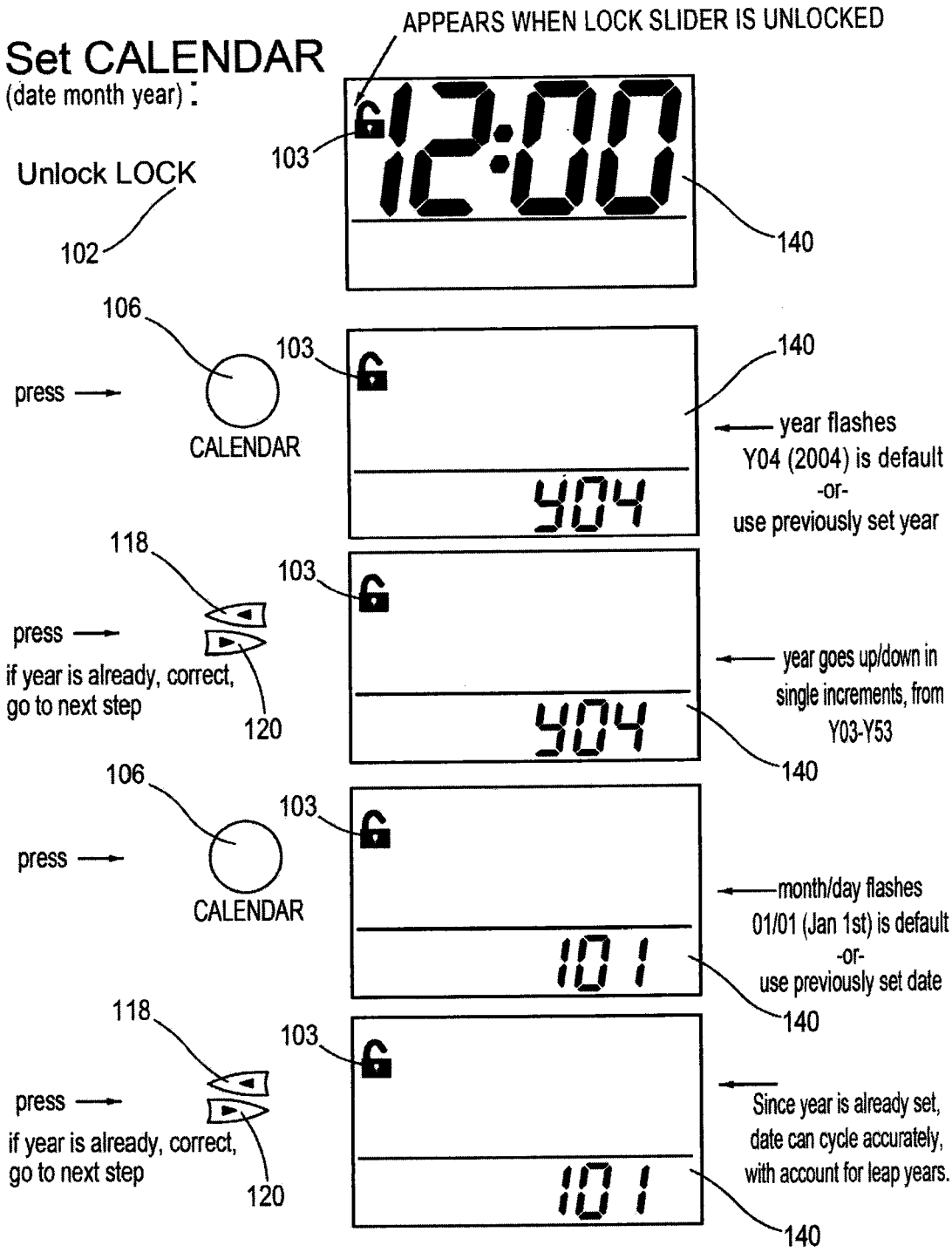
FIG. 11 is a schematic representation of the single day alarm clock of the present invention showing the sequence of how to set a calendar date on the display window for displaying a month, day and year thereon.
Figure 12:
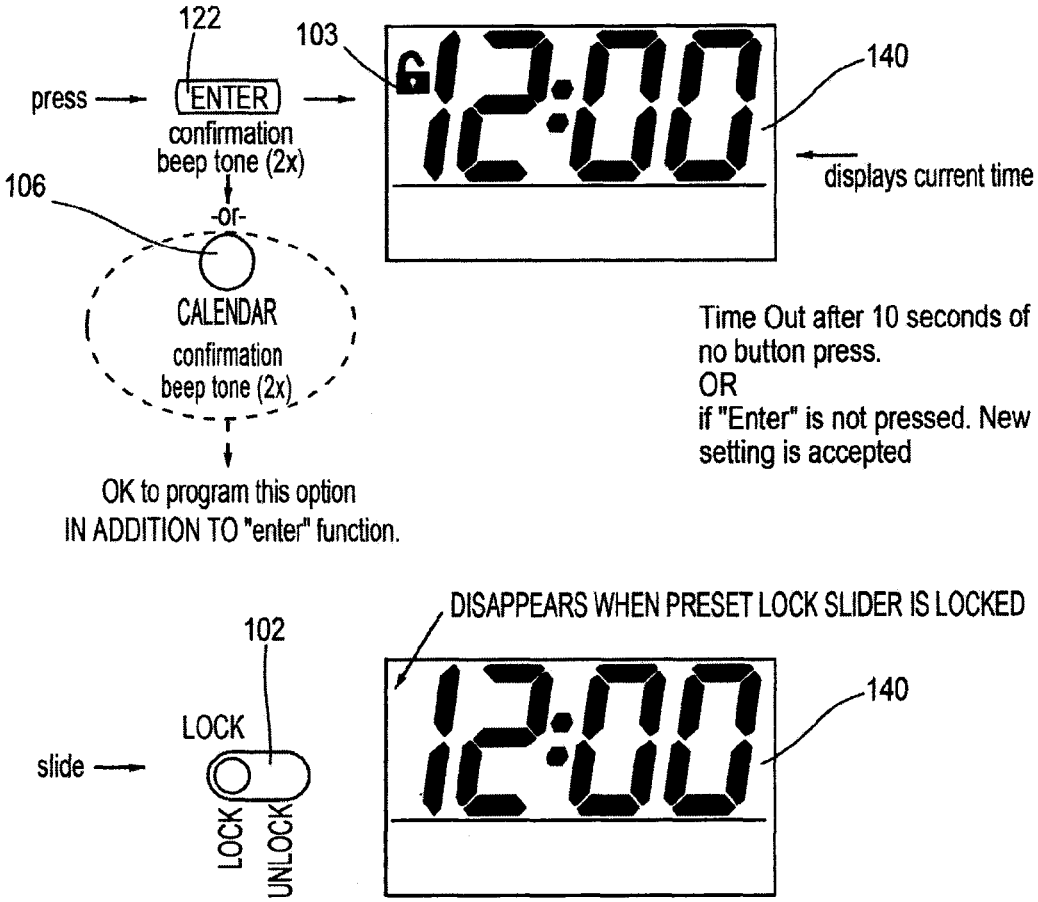
FIG. 12 is a schematic representation of the single day alarm clock of the present invention showing the sequence of how to confirm the calendar date on the display window.

FIGS. 11 and 12 illustrate how the calendar setting is preset by the factory representative.

Figure 13:
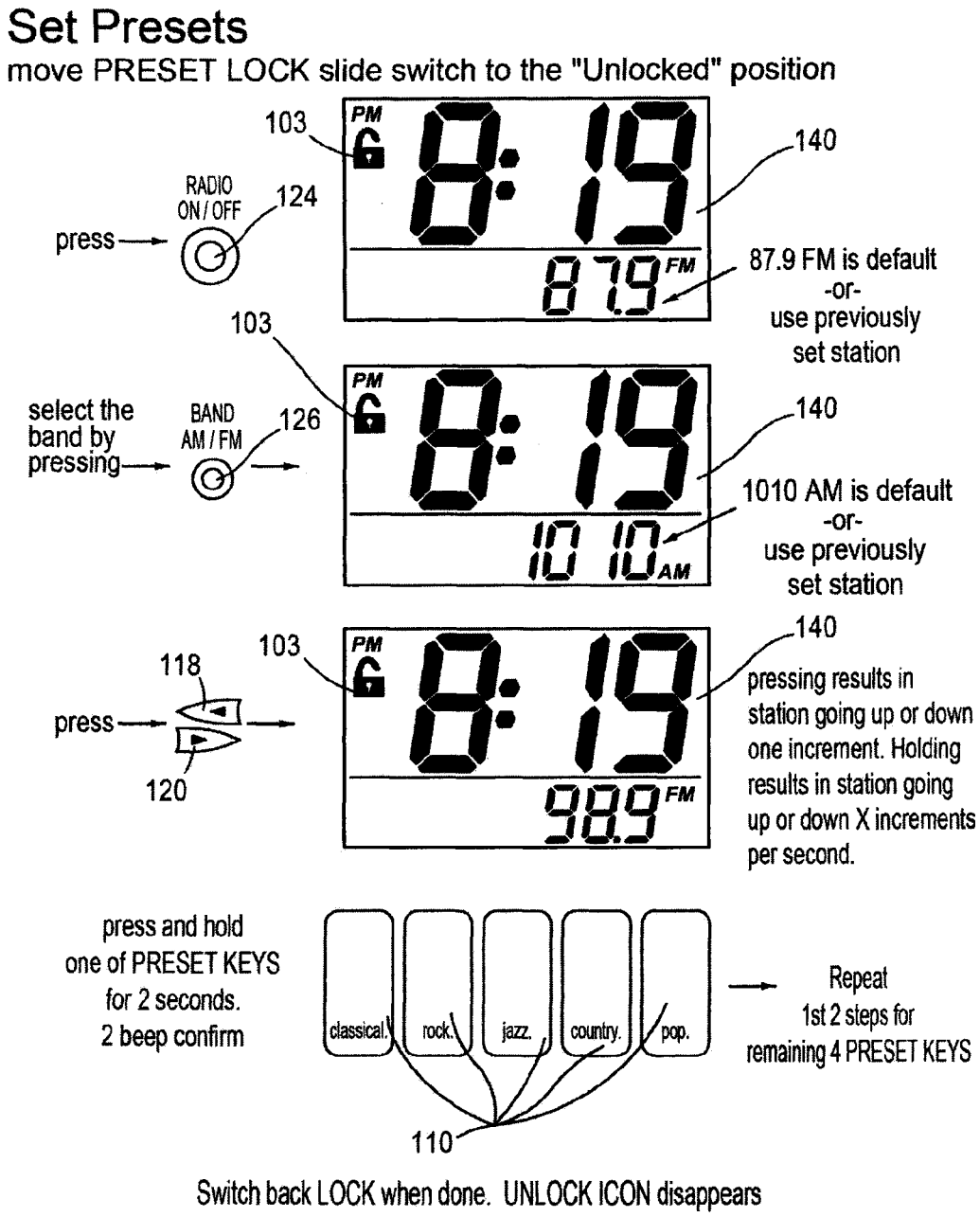
FIG. 13 is a schematic representation of the single day alarm clock of the present invention showing the sequence of how to preset a particular type of radio station on the display window for displaying a given radio station.

FIG. 13 illustrates how the hotel maintenance person presets a particular radio station. These are conventional and known operations, as previously indicated by FIG. 4 of the preferred embodiment.

Figure 14:
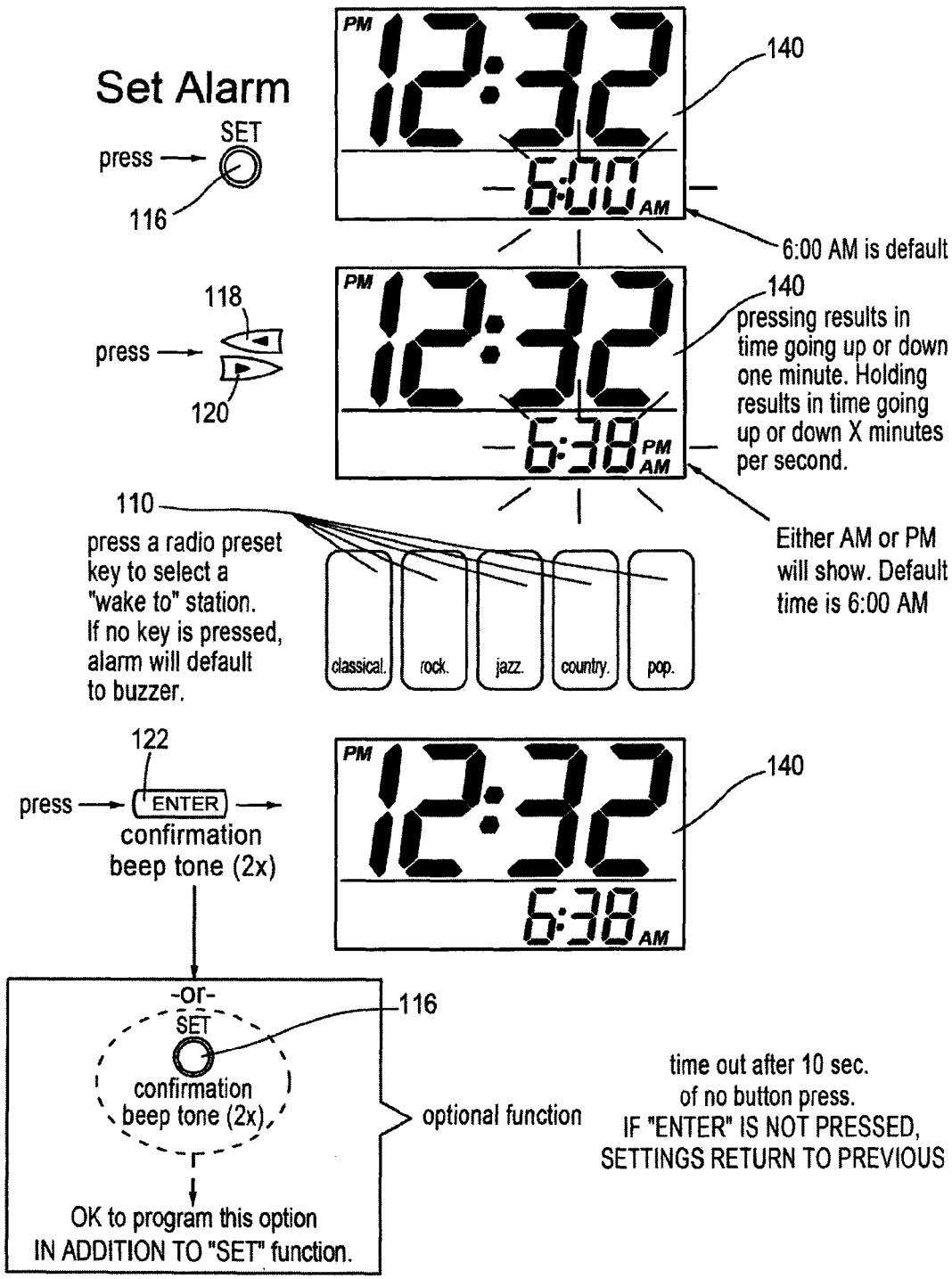
FIG. 14 is a schematic representation of the single day alarm clock of the present invention showing the sequence of how to set a wake-up time for the alarm on the display window for displaying a selected wake-up time.
Figure 15:
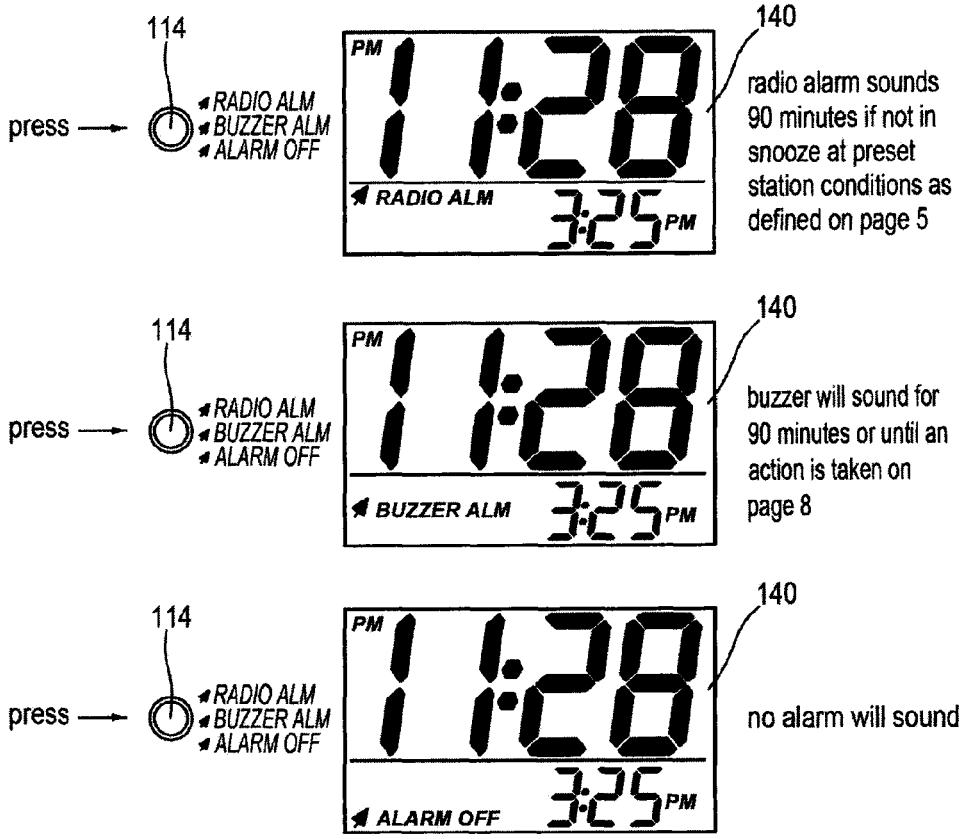
FIG. 15 is a schematic representation of the single day alarm clock of the present invention showing the sequence of how to preset an alarm mode for the selected wake-up time on the display window for displaying a "Radio ON" mode or a "Buzzer ON" mode or an "Alarm OFF" mode.

FIGS. 14 and 15 illustrate how to set the alarm and how to set the alarm mode by the hotel guest, and follows the same programming steps as shown in FIGS. 5 and 6 of the preferred embodiment.

Figure 17:
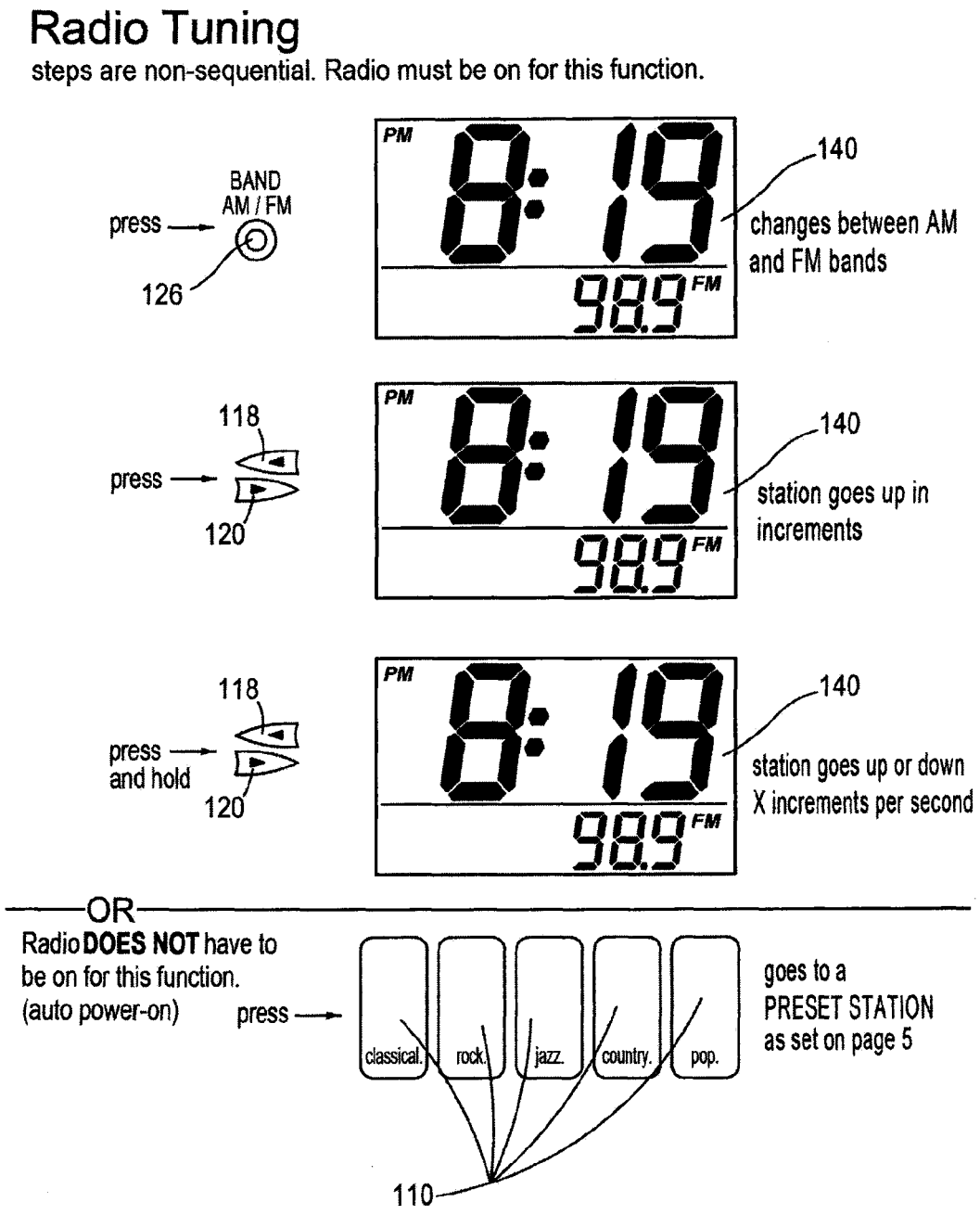
FIG. 17 is a schematic representation of the single day alarm clock of the present invention showing the sequence of how to tune-in a particular radio station on the display window.

FIG. 16 illustrates how to operate the snooze bar, and how to operate the clock dimmer. FIG. 17 illustrates how to tune the radio. These are conventional and known operations.

Figure 18:
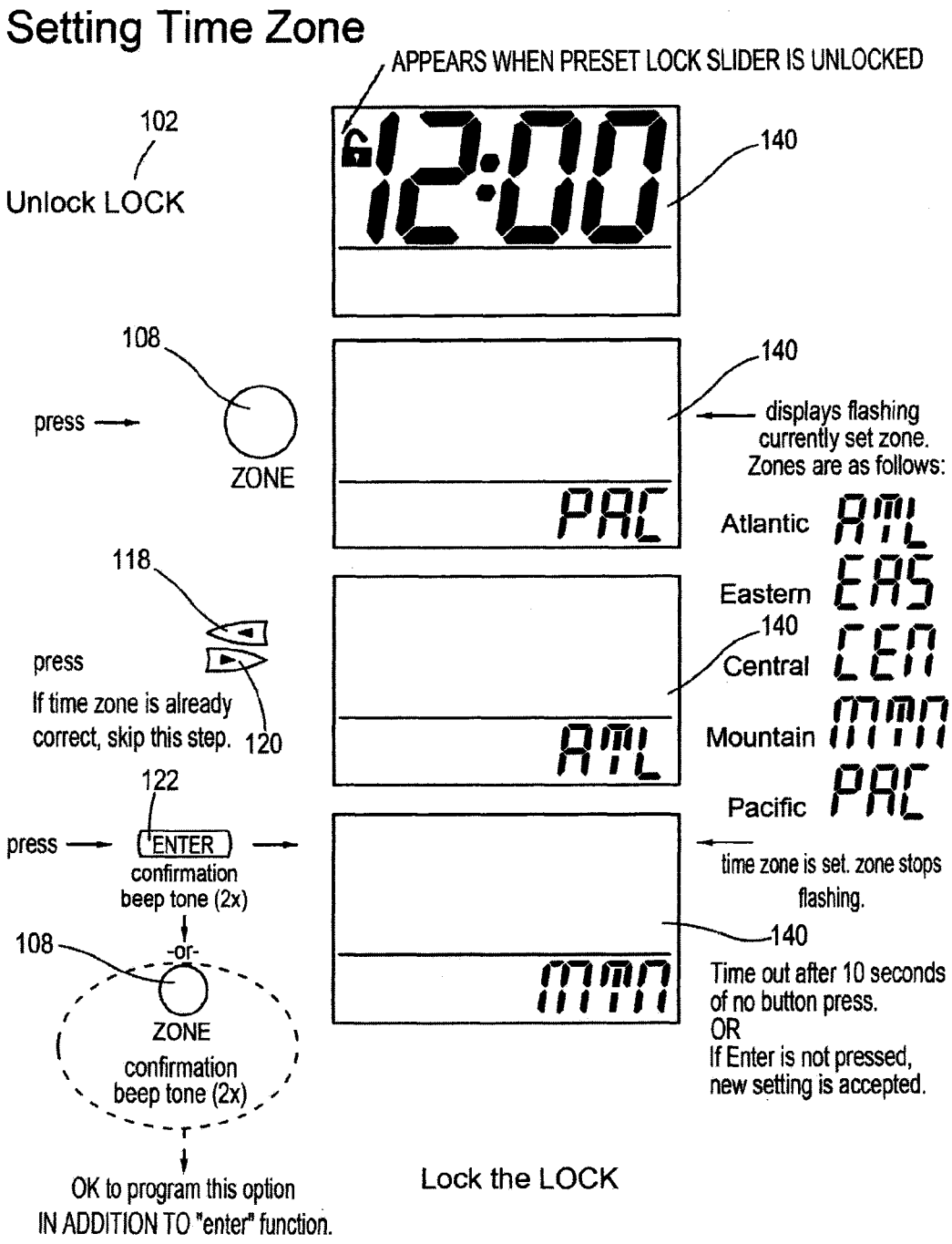
FIG. 18 is a schematic representation of the single day alarm clock of the present invention showing how to set a time zone on the display window for displaying a particular time zone, such as the pacific time zone.

FIG. 18 illustrates how to set a particular time zone using zone button 108.

Figure 19A:
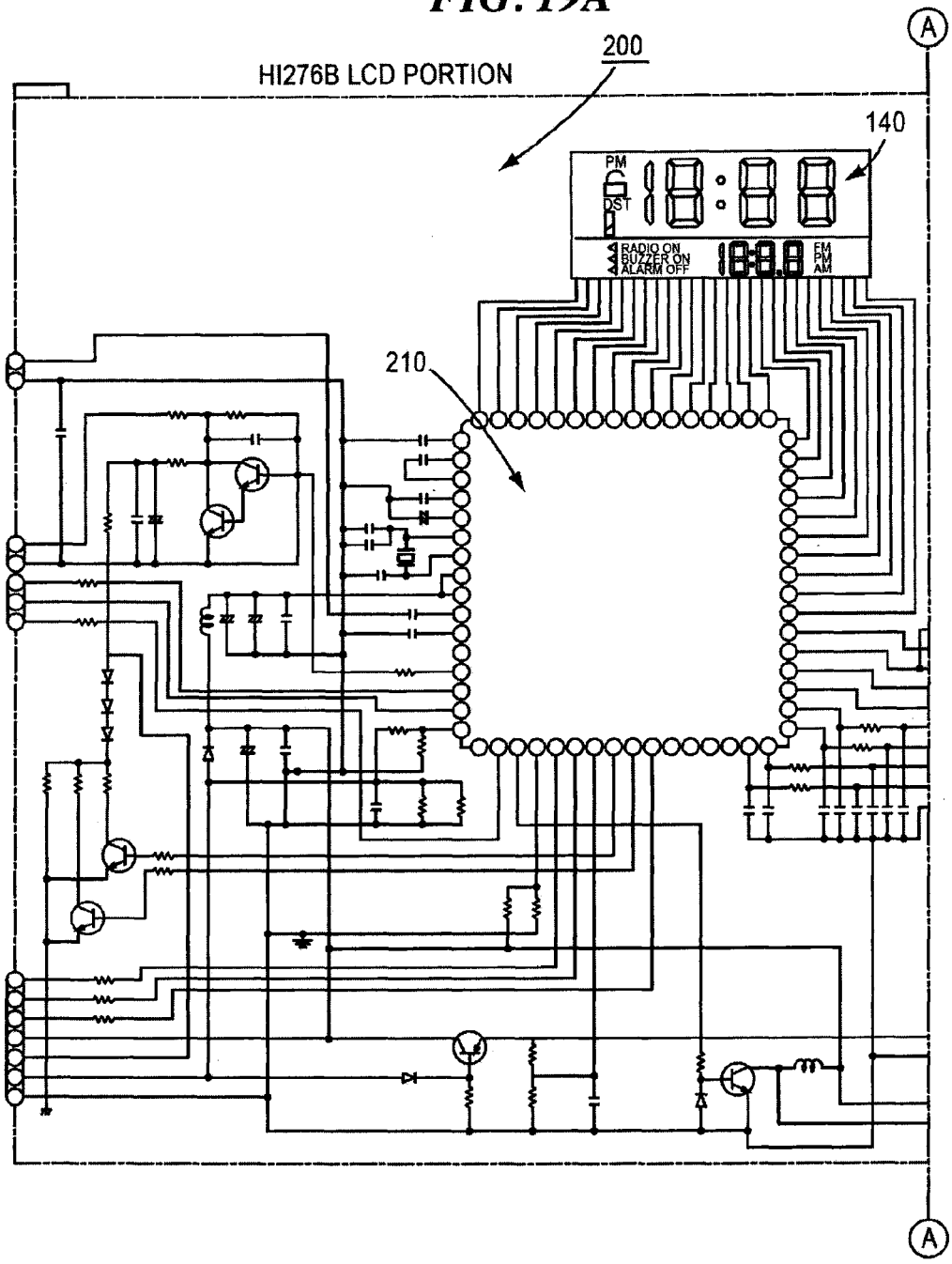
FIG. 19 is a schematic block diagram of the single day alarm clock of the present invention showing the clock radio electrical circuit wiring for its major component parts being electrically connected thereto.
Figure 19B:
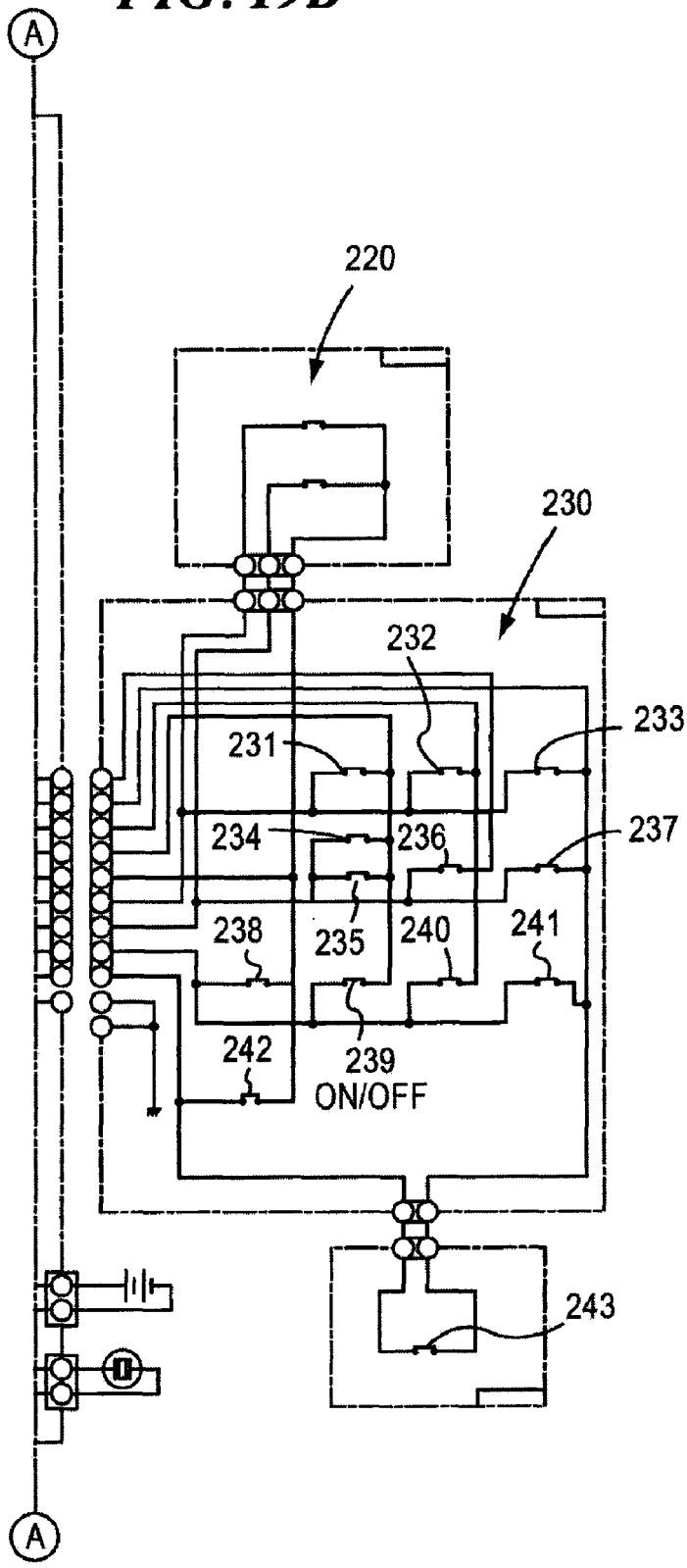

FIG. 19 depicts an electrical schematic block diagram showing the clock radio circuitry 200 having the window display screen 140 connected to a software and logic pc board 210. An on/off pc board 220 is connected to a control board 230 with multiple switches 231, 232, 233, 234, 235, 236, 237, 238, 239, 240, 241, 242 and 243 thereon. The control board 230 is electrically connected to the software and logic pc board 210 for controlling the functions of switches 231 to 243, as shown in FIG. 19.

As a result of the alternate embodiment 100 of the present invention, a hotel guest arrives in the room, and the clock radio 100 has been preset in the manner described above. The advantage is that whatever alarm time has been preset for the alarm to go off the previous night, by a prior guest, it will not stay preset for the new guest. The preset alarm time will automatically be deactivated and will change the alarm to the "off" mode, and automatically cancels whatever alarm time has been preset by the prior hotel guest. The new hotel guest is then free to set the alarm in the manner described above.

The software in the software and logic pc board 210 controls the alarm so that after the alarm has sounded, the software 210 automatically cancels or disarms the preset alarm time so the alarm setting changes to the "off" mode. In this manner, the new hotel guest is not subject to the preset alarm time of the previous hotel guest.

ADVANTAGES OF THE PRESENT INVENTION

Accordingly, an advantage of the present invention is that it provides for a single day alarm clock that automatically deactivates a preset alarm setting after the alarm sounds such that a hotel guest is not subject to a previous alarm wake-up time.

Another advantage of the present invention is that it provides for a single day alarm clock that is easy to program and easy to use by a hotel guest.

Another advantage of the present invention is that it provides for a single day alarm clock that can be mass produced in an automated and economical manner and is readily affordable by a user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A single day alarm clock radio, comprising:

a) a plurality of setting buttons for setting time, for setting different types of music and news or for setting one or more radio stations;

b) alarm buttons for changing alarm settings including alarm time and alarm mode;

c) a preset locking switch for locking or unlocking the clock radio to disable or enable, respectively, at least one of the time to be preset, and at least a radio station to be preset or a type of music or news to be preset, wherein, when the preset locking switch is in a locked position, the plurality of setting buttons are disabled and at least the alarm buttons are enabled to allow changes to the alarm settings; and d) means for automatically cancelling a preset alarm setting to an alarm off mode after the alarm has sounded so that a new user is not subject to the preset alarm setting of a previous user.

2. A single day alarm clock radio in accordance with claim 1, further including a display window for displaying the time.

3. A single day alarm clock radio in accordance with claim 1, wherein said preset locking switch is in the form of a slide switch.

4. A single day alarm clock radio in accordance with claim 1, wherein said alarm buttons include an alarm set button for setting a particular alarm time by the new user.

5. A single day alarm clock radio in accordance with claim 1, wherein said alarm buttons include an alarm off button for turning off the preset alarm setting.

6. A single day alarm clock radio in accordance with claim 1, further including a pair of alarm time buttons for increasing and decreasing the alarm time set by the new user.

7. A single day alarm clock radio in accordance with claim 1, wherein the alarm mode including one or more of a radio mode, a buzzer mode, and an alarm off mode.

8. A single day alarm clock radio in accordance with claim 2, wherein the display window displays: (i) the "lock" status indicator when the preset locking switch is in the locked position; and (ii) the "unlock" status indicator when the preset locking switch is in the unlocked position.

9. A single day alarm clock radio in accordance with claim 1, wherein, when the preset locking switch is in the unlocked position, the plurality of setting buttons are enabled to allow changes to music or news settings or one or more radio stations.

10. An alarm clock radio comprising:

a first user interface for setting time of the clock radio;

a second user interface for setting different types of music or news or for setting one or more radio stations;

a third user interface for changing alarm settings including alarm time and alarm mode; and a preset locking switch for locking or unlocking the clock radio to disable or enable, respectively, at least one of the time to be preset and at least a radio station to be preset or a type of music or news to be preset, wherein, when the preset locking switch is in a locked position, the first user interface and the second user interface are disabled and the third user interface is enabled to allow changes to the alarm settings.

11. The clock radio in accordance with claim 10, wherein the alarm mode includes one or more of a radio mode, a buzzer mode, and an alarm off mode.

12. The clock radio in accordance with claim 10, further comprises a memory for storing the time settings, the music, news or radio settings and the alarm settings.

13. The clock radio in accordance with claim 10, further comprises a processor operable to automatically cancel a preset alarm setting to an alarm off mode after the alarm has sounded so that a new user is not subject to the preset alarm setting of a previous user.

14. The clock radio in accordance with claim 10, wherein the third interface allows increasing and decreasing of the alarm time setting.

15. The clock radio in accordance with claim 10, further comprises a display for displaying the time settings and alarm settings.

16. The clock radio in accordance with claim 15, wherein the display displays: (i) the "lock" status indicator when the preset locking switch is in the locked position; and (ii) the "unlock" status indicator when the preset locking switch is in the unlocked position.

17. A method for setting an alarm clock radio having a plurality of time setting buttons, media setting buttons, alarm setting buttons and a preset locking switch, the method comprising:

presetting by a first user time on the clock radio using one or more time setting buttons;

presetting by the first user different types of music or news or presetting one or more radio stations using one or more media buttons; and activating a preset locking switch by the first user, whereby the time setting buttons and media setting buttons are disabled and one or more alarm setting buttons are enabled to allow changes to alarm settings by a second user.

18. The method in accordance with claim 17, wherein the alarm settings include an alarm time and an alarm mode.

19. The method in accordance with claim 18, wherein the alarm mode includes one or more of a radio mode, a buzzer mode, and an alarm off mode.

* * * * *